United States Patent [19]

Meyer

[11] Patent Number: 5,074,016

[45] Date of Patent: Dec. 24, 1991

[54] MACHINE FOR CRIMPING TEXTILE THREADS

[75] Inventor: Clément Meyer, Bernwiller, France

[73] Assignee: Passap Knitting Machines Inc., Salt Lake City, Utah

[21] Appl. No.: 588,692

[22] Filed: Sep. 27, 1990

[30] Foreign Application Priority Data

Sep. 28, 1989 [FR] France ..... 89 12868

[51] Int. Cl.[5] ..... D02G 1/12

[52] U.S. Cl. ..... 28/263

[58] Field of Search ..... 28/263, 264, 265, 267

[56] References Cited

U.S. PATENT DOCUMENTS

| | | | |
|---|---|---|---|
| 4,040,155 | 8/1977 | Hughes et al. | 28/265 X |
| 4,067,092 | 1/1978 | Roberts | 28/264 X |
| 4,075,746 | 2/1978 | Roberts | 28/264 |
| 4,081,886 | 4/1978 | Roberts | 28/264 X |

FOREIGN PATENT DOCUMENTS

| | | | |
|---|---|---|---|
| 719039 | 10/1965 | Canada | 28/264 |
| 45-009148 | 4/1970 | Japan | 28/264 |
| 47-234667 | 8/1972 | Japan | 28/264 |
| 690063 | 4/1953 | United Kingdom | 28/267 |
| 1415655 | 11/1975 | United Kingdom | 28/264 |
| 2136025 | 9/1984 | United Kingdom | 28/264 |

*Primary Examiner*—Werner H. Schroeder
*Assistant Examiner*—John J. Calvert
*Attorney, Agent, or Firm*—Davis, Bujold & Streck

[57] ABSTRACT

The present invention concerns a machine for continuously crimping textile threads. The machine (10) comprises a frame composed of a support plate (14) to which there are attached two upper blocks (17*a* and 17*b*) defining a compression chamber (18), two elements (19*a* and 19*b*) defining a decompression chamber (20) and two paddles (21*a* and 21*b*) defining an evacuation chamber (22). The threads are introduced into the compression chamber by two pulleys (25*a* and 25*b*). The decompression chamber (20) is supplied with steam through conduits (31*a* and 31*b*). The paddles (21*a* and 21*b*) are subject to the action of two spring blocks (33*a* and 33*b*). This machine is used to cause crimping and bulking of all kinds of threads, and for fixing the crimping and inflation.

5 Claims, 2 Drawing Sheets

MACHINE FOR CRIMPING TEXTILE THREADS

Figure 1:
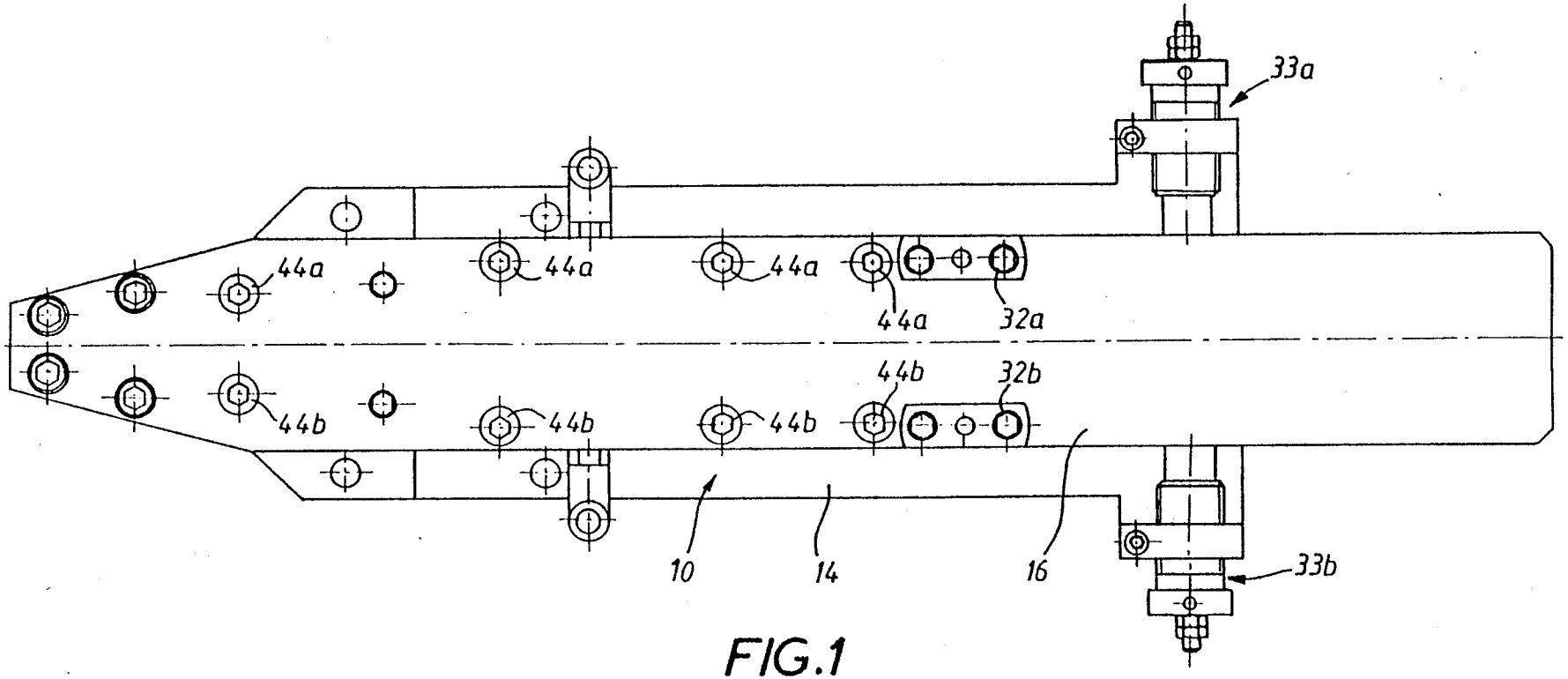

The present invention concerns a machine for continuously crimping textile thread, comprising a frame defining an elongated enclosure open at both extremities, with walls equipped with steam injection nozzles, the opening at the upstream extremity being controlled by two pulleys for driving the thread, and the opening at the downstream extremity being controlled by at least one pivoting paddle.

There are several known devices for physical, chemical or heat treatment of textile thread, particularly of synthetic polyamide, polyester, polypropylene or acrylics and wool, or those made of a blend of these materials.

Crimping is a characteristic in great demand (particularly in the knitting and carpet industries) and often difficult for producers to achieve. Specific forms or techniques presently known for crimping thread consist of using streams of air, of passing the thread through mechanical equipment, or of supertwisting the thread, then putting it in skeins, steaming or heat fixing it while at the same time causing it to undergo a mechanical treatment in rotating drums, and removing it from the skeins. This latter process is particularly long and costly, as it necessitates several successive operations but nevertheless cannot ensure regular development of crimping of the thread or threads.

The present invention proposes resolving this problem in an effective and economical manner by providing producers with a machine for continuously crimping textile threads, whatever their dimension and whatever their intended use.

To achieve this, the machine according to the invention is characterized in that the said enclosure comprises a compression chamber and a decompression chamber disposed one after the other in the direction of thread passage.

According to a preferred embodiment, the compression chamber is defined by two blocks tangentially positioned on the drive pulleys and adjustable in position so that the dimensions of the compression chamber are adjustable.

Preferably, the blocks have one surface in tangential contact with the drive pulleys and one surface forming an angle with the first surface ranging from 5° to 90°.

According to a preferred embodiment, the blocks define two shoulder pieces which separate the compression chamber from the decompression chamber.

Advantageously, the steam injection nozzles are disposed in lateral elements defining the decompression chamber.

Preferably, the said pivoting paddle is associated with a spring block disposed to urge the paddle in a direction corresponding to closure of the said downstream enclosure opening.

According to a preferred embodiment, the machine comprises two paddles symmetrically disposed with respect to the axis of the enclosure, the two paddles being respectively articulated at one extremity to the lateral elements of the decompression chamber and respectively associated with a spring block for pushing the corresponding paddle in the direction of the other.

Figure 2:
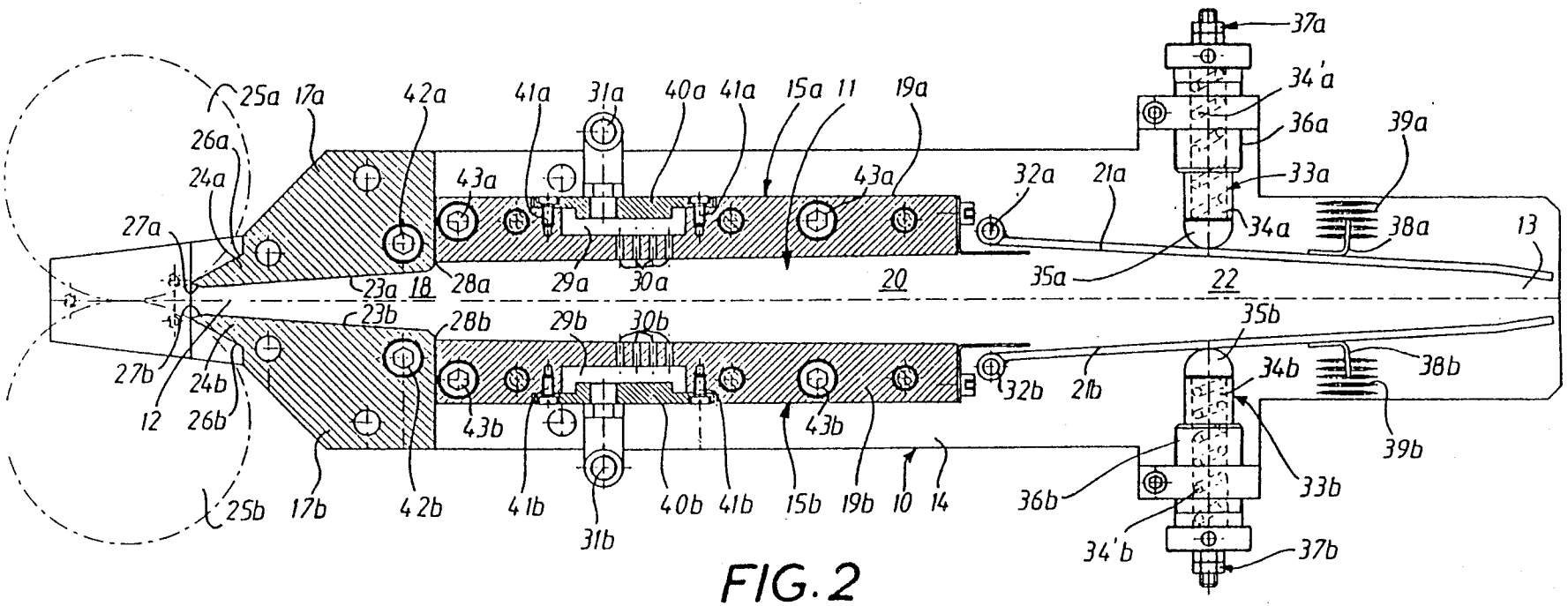

The present invention and its advantages will be more apparent in the following description of several embodiments presented by way of non-limiting examples, and with reference to the attached drawings, in which:

FIG. 1 is a overhead view of the crimping machine according to the invention; and FIG. 2 is an overhead view, partially in cross-section along a horizontal plane, of the machine shown in FIG. 1.

With reference to the drawings, the machine as shown comprises a frame 10 defining an elongated enclosure 11 open at both extremities, 12 and 13, respectively, when it is functioning. The frame comprises a supporting plate 14, disposed generally horizontally, two lateral walls, 15*a* and 15*b*, respectively, and a horizontal cover 16 screwed to the lateral walls in a position making it essentially parallel to base plate 10.

The lateral walls, which are symmetrical in relation to an axial vertical plane, are composed of two upstream blocks 17*a* and 17*b*, between which there is defined a chamber called compression chamber 18. The machine is further composed of two elongate elements 19*a* and 19*b*, respectively, between which there is defined a chamber called decompression (expansion) chamber 20, situated in the extension of compression chamber 18. Lastly, it is composed of two pivoting paddles, 21*a* and 21*b*, respectively, between which there is defined a holding chamber 22 opening onto the downstream opening disposed in extremity 13 of enclosure 11.

Blocks 17*a* and 17*b* define two interior surfaces, 23*a* and 23*b*, respectively, disposed across from each other and constituting the lateral walls of compression chamber 18. They further comprise two points (or chamfers) 24*a* and 24*b*, respectively, which define the upstream opening situated at extremity 12 of enclosure 11. The opening must be narrow enough, of the order of 10 mm., to prevent too much thread pressure on the pulleys, thus also preventing the thread from becoming jammed between the point and the pulley. In the area of this extremity, the machine comprises two drive pulleys 25*a* and 25*b* for propelling the thread by friction and ensuring its penetration inside enclosure 11. Points 24*a* and 24*b* are defined by a first vertical wall 26*a*, 26*b*, respectively, which is respectively tangential, with a requisite minimal play during functioning, with the lateral wall of pulleys 25*a* and 25*b* and a second vertical surface, 27*a* and 27*b*, respectively, which forms an angle preferably of from 5° to 90° with the first surface, that is surface 26*a* and 26*b*, respectively. Surfaces 27*a* and 27*b* rejoin the anterior walls 23*a* and 23*b*, respectively, of compression chamber 18 and define the upstream entry to said chamber. The exit of said chamber, which corresponds to the entry of the decompression chamber, is defined by two shoulder pieces, 28*a* and 28*b*, respectively, consisting of the lateral distance between elements 19*a* and 19*b* in relation to blocks 17*a* and 17*b*.

Elements 19*a* and 19*b* consist of two elongate pieces inside of which there are two chambers 29*a* and 29*b* which communicate with decompression chamber 20 by the intermediary of injection nozzles 30*a* and 30*b*. These injection nozzles are used to inject vapor into the decompression chamber. The vapor is conducted through two conduits 31*a* and 31*b* respectively separated from the nozzles inside chambers 29*a* and 29*b*. The role of this vapor injection will be defined in more detail below.

Paddles (pivoting shutter) 21*a* and 21*b* are articulated to two pivots 32*a* and 32*b* and are urged in the direction of closing the opening disposed in upstream extremity 13 by two spring blocks 33*a* and 33*b*, respectively. These spring blocks consist of two bushings 34*a* and 34*b* with rounded tips, respectively axially movable in contact with paddles 21*a* and 21*b*. Bushings 34*a* and 34*b* are engaged inside two ridged screws 36*a* and 36*b*, respectively, and pushed by a spring 34'*a* and 34'*b* situated in said ridged screws. The springs are pre-tightened by the positioning of the screws and counter-screws 37*a* and 37*b*, and the force they exert by the intermediary of bushings 33*a* and 33*b* against paddles 21*a* and 21*b* can be regulated by means of screws 36*a* and 36*b*, respectively. Each paddle has an angled element 38*a* and 38*b*, the free end of which is displaceable above a certain number of reference marks 39*a* and 39*b*, respectively, when the paddles open or close under the pressure exerted on the interior by the threads in enclosure 11 and under the pressure exerted from the exterior by spring blocks 33*a* and 33*b*.

The degree of crimping is a function of the position of the two paddles and is reproducible by using the same reference points 39*a* and 39*b* during different experiments.

The crimping machine described above functions in the following manner: at the moment the process begins, the pressure exerted by spring blocks 33*a* and 33*b* against pivoting paddles 21*a* and 21*b* is sufficient to close the downstream opening disposed at extremity 13 of enclosure 11 of the crimping machine. Drive rollers 25*a* and 25*b* introduce the thread into the enclosure, which fills progressively. When the enclosure is filled and the threads are packed inside enclosure 11, counter pressure is exerted on paddles 21*a* and 21*b*, tending to open them by working against the pressure exerted by the spring blocks. From this moment on the machine becomes truly operational and the thread crimping process can begin. The threads driven by the friction of drive pulleys 25*a* and 25*b* become packed in compression chamber 18 while pushing back the mass of threads in decompression chamber 20 and evacuation chamber 22. This compression has the effect of causing the thread to become crimped. When the threads treated in the compression chamber penetrate into the decompression chamber, they are submitted to an atmosphere of hot steam which has the effect of fixing the crimping and bulking the thread. The mass of threads disposed in evacuation chamber 22 pushes back the spring blocks slightly and allows paddles 21*a* and 21*b* to open so the threads may be evacuated and taken up by winding machines (not shown) or other known devices. The pressure exerted by the spring blocks on the paddles must be regulated so that the counter-pressure exerted by the mass of threads inside evacuation chamber 22 is sufficient to open the paddles slightly and allow the threads to be removed, but not so strong as to allow a mass evacuation of threads, capable of emptying evacuation chamber 22 and thereafter, decompression chamber 20. The injection of steam into the decompression chamber ensures fixation of the crimping generated inside the compression chamber. The steam cannot escape toward compression chamber 18 because of the presence of the two shoulder pieces 28*a* and 28*b*, the mass of threads compressed inside compression chamber 18, and the narrow opening of said compression chamber, serving as a stopper. Because of this, the steam does not travel as far as the pulleys and therefore does not condense, and the thread does not stick to the pulleys. The broken angles formed at the extremities of points 24*a* and 24*b* are particularly important, as they prevent the thread from becoming squeezed between the points and the pulleys, disengagement allowing the thread to pass freely.

In the drawing of the construction of the machine, it will be noted that steam chambers 29*a* and 29*b* are disposed in elements 19*a* and 19*b*, respectively, and blocked by closing plates 40*a* and 40*b*, respectively, held in place by screws 41*a* and 41*b*. Blocks 17*a* and 17*b* are, for example, attached to support plate 14 by means of screws 42*a* and 42*b*. Elements 19*a* and 19*b* are preferably attached to the support plate by screws 43*a* and 43*b*. Cover 16 is attached to the unit by means of several screws 44*a* and 44*b*.

It is obvious that the present invention is not limited to the form of embodiment nor the horizontal position shown, but may be modified by one skilled in the art and may assume various forms without departing from the realm of the invention. In particular, blocks 17*a* and 17*b* could be adjustable in position so that the transverse dimensions of the compression chamber could be modified as a function of the type of thread to be treated. Furthermore, the blocks could be made of several components comprising at least one support disposed toward the outside and one crosspiece disposed toward the inside and comprising surface 23*a* (surface 23*b*, respectively) and point 24*a* (point 24*b*, respectively).

I claim:

1. A stuffer-box crimping machine for crimping continuously textile thread comprising a box, defining an elongate chamber which is open at both extremities, provided with inner walls equipped with steam injection nozzles, the opening of the elongate chamber located at a textile thread entrance extremity being controlled by two driving rolls and the opening of the elongate chamber located at a textile thread exit extremity being controlled by at least one pivoting shutter, and said elongate chamber comprising a compression chamber and an expansion chamber sequentially arranged along a travel direction of the textile thread through the machine, wherein the compression chamber is delimited laterally by two entrance blocks, and each of said two entrance blocks comprise a first face tangential to one of the driving rolls and a foremost portion of a second face forming with said first face a triangular chamfer having an angle of between 5 and 90 degrees.

2. A machine according to claim 1, wherein said two entrance blocks are provided with two shoulders which define a separation between the compression chamber and the expansion chamber.

3. A machine according to claim 1, wherein said steam injection nozzles are connected to lateral elements constituting the side walls of the expansion chamber.

4. A machine according to claim 1, wherein said at least one pivoting shutter cooperates with a spring arrangement biasing said at least one pivoting shutter in a direction tending to prevent the textile thread from exiting said exit extremity of the elongate chamber.

5. A machine according to claim 1, wherein the machine comprises two pivoting shutters disposed symmetrically on both lateral sides of a longitudinal axis defined by the elongate chamber, said two pivoting shutters are mounted pivotally at one of their ends to lateral elements of the expansion chamber, and each pivoting shutter cooperates with a spring arrangement biasing said pivoting shutters in a direction tending to prevent the textile thread from exiting said exit extremity of the elongate chamber.

* * * * *